US006715301B2

(12) United States Patent
Song

(10) Patent No.: US 6,715,301 B2
(45) Date of Patent: Apr. 6, 2004

(54) APPARATUS AND METHOD FOR CONTROLLING DRIVING OF RECIPROCATING COMPRESSOR FOR REFRIGERATOR USING LINEAR MOTOR

(75) Inventor: Gye-Young Song, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/282,035

(22) Filed: Oct. 29, 2002

(65) Prior Publication Data

US 2003/0209015 A1 Nov. 13, 2003

(30) Foreign Application Priority Data

May 13, 2002 (KR) ..... 2002-26210

(51) Int. Cl.[7] ..... F25B 9/00

(52) U.S. Cl. ..... 62/6; 62/228.1

(58) Field of Search ..... 62/6, 190, 228.1, 62/230

(56) References Cited

U.S. PATENT DOCUMENTS 6,520,746 B2 * 2/2003 Yoo et al. ..... 417/44.11
6,527,519 B2 * 3/2003 Hwang et al. ..... 417/44.11
6,537,034 B2 * 3/2003 Park et al. ..... 417/44.11
6,554,577 B2 * 4/2003 Park et al. ..... 417/44.11

* cited by examiner

*Primary Examiner*—Denise L. Esquivel
*Assistant Examiner*—Malik N. Drake
(74) *Attorney, Agent, or Firm*—Fleshner & Kim, LLP

(57) ABSTRACT

Disclosed is an apparatus and a method for controlling a driving of a reciprocating compressor for a refrigerator using a linear motor, in which a capacitance is varied according to a variation of a driving load, thereby improving a driving efficiency of the compressor. To this end, the apparatus for controlling a driving of a reciprocating compressor for a refrigerator using a linear motor comprises a first capacitor for attenuating an inductance of a coil wound on a motor; a second capacitor connected to the first capacitor in parallel; and a relay connected to the second capacitor in series to be turned on/off; and a microcomputer for outputting a control signal to turn on/off the relay according to the driving load of the refrigerator.

15 Claims, 8 Drawing Sheets

APPARATUS AND METHOD FOR CONTROLLING DRIVING OF RECIPROCATING COMPRESSOR FOR REFRIGERATOR USING LINEAR MOTOR

BACKGROUND OF THE INVENTION

1. Field of the Invention

The present invention relates to a reciprocating compressor for a refrigerator using a linear motor, and particularly, to an apparatus and a method for controlling a driving of the reciprocating compressor for a refrigerator using a linear motor in which capacitance is varied according to a variation of a driving load, thereby improving a driving efficiency of a compressor.

2. Description of the Background Art

As well-known, a compressor compresses a refrigerant circulated in a cooling apparatus such as an air conditioner and a refrigerator into a high temperature and high pressure. The compressor includes a reciprocating compressor, a rotary compressor, a brushless direct current (BLDC) compressor, and an ability variable-type reciprocating compressor called as an inverter compressor and having a varied rotary speed.

The reciprocating compressor using a linear motor varies a piston stroke thereof according to a voltage applied to a motor, thereby controlling a cooling capacity by a user's intention.

The reciprocating compressor will be explained with attached drawings.

FIG. 1 shows an apparatus for controlling a driving of a general reciprocating compressor.

Referring to FIG. 1, an apparatus for controlling a driving of a reciprocating compressor comprises a reciprocating compressor 100 for controlling a cooling capacity by varying a stroke of an inner piston by a voltage input to an inner motor M according to a stroke reference value set by a user: a voltage detecting unit 102 for detecting a motor voltage applied to the reciprocating compressor 100 by varying the piston stroke of the reciprocating compressor 100; a current detecting unit 104 for detecting current applied to the reciprocating compressor 100 by varying the piston stroke of the reciprocating compressor 100; a microcomputer 106 for calculating a stroke value by using detected voltage and current from the voltage detecting unit 102 and the current detecting unit 104, comparing the calculated stroke value with the stroke reference value, then outputting a switching control signal according to the comparison between the calculated stroke value and the stroke reference value; and an electric circuit unit 108 for controlling a size of the motor voltage applied to the reciprocating compressor 100 according to interrupting an AC power source to a triac Tr1 controlled by a switching control signal of the microcomputer 106.

Operations for controlling a driving of the general reciprocating compressor will be explained.

The reciprocating compressor 100 controls a cooling capacity by a varied piston stroke, wherein the piston reciprocates up and down by the motor voltage input from the motor according to the stroke reference value set by a user.

The stroke means a distance that a piston in the reciprocating compressor 100 moves with reciprocation.

A period of turn-on of the triac Tr1 in the electric circuit unit 108 becomes long by a control signal of the microcomputer 106, so that a stroke is increased. At this time, the voltage detecting unit 102 and the current detecting unit 104 respectively detect voltage and current applied to the reciprocating compressor 100, and output the detected voltage and current to the microcomputer 106.

The microcomputer 106 calculates a stroke by using voltage and current detected from the voltage detecting unit 102 and the current detecting unit 104, compares the calculated stroke with a stroke reference value set by a user, and outputs a switching control signal to the triac Tr1 according to the comparison between the calculated stroke and the stroke reference value.

That is, when the calculated stroke is smaller than the stroke reference value, the microcomputer 106 outputs the switching control signal which lengthens the period of turn-on of the triac Tr1, thereby increasing a voltage applied to the reciprocating compressor 100.

In the meantime, when the calculated stroke is greater than the stroke reference value, the microcomputer 106 outputs the switching control signal which shortens the period of turn-on of the triac Tr1, thereby decreasing a voltage applied to the reciprocating compressor 100.

A relation between a voltage (V) applied to a motor (M) of the reciprocating compressor 100 and a stroke will be shown as follows.

$$V = L\frac{di}{dt} + Ri + \alpha\omega S \qquad \text{[Equation 1]}$$

$$\omega = 2\pi f$$

Wherein, $\alpha$ indicates a motor constant for converting electric force into mechanical force, S indicates stroke, R indicates inner resistance of a motor, and L indicates inductance of a motor (M).

As shown in the equation 1, inductance voltage $$\left(L\frac{di}{dt}\right)$$

is almost similar to counter-electromotive force ($\alpha\omega S$), and voltage (Ri) of inner resistance (R) of the reciprocating compressor 100 is a small value possible to ignore when compared with the $$\left(L\frac{di}{dt}\right)$$

and the counter-electromotive force ($\alpha\omega S$).

Therefore, voltage (V) applied to the motor (M) is determined by a sum of the inductance voltage $$\left(L\frac{di}{dt}\right)$$

and the counter-electromotive force ($\alpha\omega S$).

Accordingly, to get a greater stroke in the reciprocating compressor, voltage applied to the motor has to be great.

To improve efficiency of the reciprocating compressor, inductance value of a coil wound on the motor has to be small.

That is, as shown in FIG. 2, capacitor (C) is connected to the motor (M) in series and attenuates an inductance (L) of a coil wound on the motor, thereby improving efficiency of the reciprocating compressor.

FIG. 2 is a block diagram of a reciprocating compressor in accordance with the conventional art.

Referring to FIG. 2, an operation for attenuating inductance of the coil will be explained. Voltage applied to the motor and both ends of the capacitor is shown as a following equation.

$$V = L\frac{di}{dt} + \frac{1}{C}\int i dt + Ri + \alpha\omega S \quad \text{[Equation 2]}$$

At this time, capacitance (C) is shown as a following equation.

$$C = \frac{1}{(2\pi f)^2}L \quad \text{[Equation 3]}$$

Wherein, the capacitance (C) and the inductance (L) are predetermined as resonant values.

Accordingly, the capacitance (C) and the inductance (L) are attenuated by being resonated each other, so that voltage applied to the motor (M) and both ends of the capacitor is shown as a following equation.

$$V=Ri+\alpha\omega s \quad \text{[Equation 4]}$$

As shown in the equation 4, the applied voltage (V) has a similar size as the counter-electromotive force ($\alpha\omega S$) because the inductance voltage $$\left(L\frac{di}{dt}\right)$$

and capacitor voltage $$\left(\frac{1}{C}\int i dt\right)$$

are attenuated after being resonated each other. Therefore, the reciprocating compressor can obtain a necessary stroke with just a low voltage (V).

Also, because the capacitor voltage $$\left(\frac{1}{C}\int i dt\right)$$

is applied to the motor (M) together with the applied voltage (V) applied to the motor and both ends of the capacitor, a great stroke can be obtained with a low voltage, thereby improving a corresponding capacity to overload.

In case of that the conventional-art reciprocating compressor is adopted to a refrigerator and driven, necessary voltage for the motor (M) of the reciprocating compressor 100 to obtain a constant stroke becomes different according to a driving load of a refrigerator.

That is, the motor M of the reciprocating compressor 100 requires voltage greater than line voltage (in Korea, AC 220) when the driving load of a refrigerator is greater, and requires voltage smaller than line voltage when the driving load of a refrigerator is smaller.

Accordingly, the microcomputer 106, in case that the driving load of a refrigerator is great, shortens off-time of the triac Tr1, thereby increasing voltage applied to the motor, and in case that the driving load of a refrigerator is small, it lengthens off-time of the triac Tr1, thereby decreasing voltage applied to the motor.

At this time, waveforms of current by voltage applied to the motor according to the driving load of the refrigerator is shown in FIGS. 3*a* and 3*b*.

FIG. 3A is a current waveform in case that the driving load of the refrigerator is great, and FIG. 3B is a current waveform in case that the driving load of the refrigerator is small.

As aforementioned, the reciprocating compressor of the conventional art lengthens off-time of triac to decrease voltage applied to the motor, thereby increasing harmonic wave loss and then lowering efficiency of the reciprocating compressor.

SUMMARY OF THE INVENTION

Therefore, an object of the present invention is to provide an apparatus' and a method for controlling a driving of a reciprocating compressor for a refrigerator using a linear motor so as to control a necessary voltage of a motor for obtaining a predetermined stroke by varying a capacitance according to a variation of a driving load of a refrigerator.

To achieve these and other advantages and in accordance with the purpose of the present invention, as embodied and broadly described herein, there is provided an apparatus for controlling a driving of a reciprocating compressor for a refrigerator using a linear motor, in a reciprocating compressor for a refrigerator which controls a cooling capacity by varying a stroke of a piston reciprocating up and down by a voltage applied to the inner motor according to an on/off state of a triac Tr1, the apparatus comprises a first capacitor for attenuating an inductance of a coil wound on the motor M; a second capacitor connected to the first capacitor in parallel; a relay Ry connected to the second capacitor in series to be turned on/off; and a microcomputer for outputting a control signal to turn on/off the relay according to the driving load of the refrigerator.

Wherein, the microcomputer outputs a control signal for turning on the relay if the driving load of the refrigerator is small; and outputs a control signal for turning off the rely if the driving load of the refrigerator is great.

To achieve these and other advantages and in accordance with the purpose of the present invention, as embodied and broadly described herein, there is provided an apparatus for controlling a driving of a reciprocating compressor for a refrigerator using a linear motor, in a reciprocating compressor for a refrigerator which controls a cooling capacity by varying a stroke of a piston reciprocating up and down by a voltage applied to the inner motor according to an on/off state of a triac, the apparatus comprises a first capacitor connected to the motor; a second capacitor connected to the first capacitor in parallel; a relay connected to the second capacitor in series to be turned on/off; and a microcomputer for outputting a control signal to turn on/off the relay according to the driving load of the refrigerator, wherein a series combination between the first and second capacitors is set to attenuate an inductance of a coil wound to the motor.

Wherein, the microcomputer outputs a control signal for turning on the relay if the driving load of the refrigerator is small; and outputs a control signal for turning off the rely if the driving load of the refrigerator is great.

To achieve these and other advantages and in accordance with the purpose of the present invention, as embodied and broadly described herein, there is provided a method for controlling a driving of a reciprocating compressor for a refrigerator using a linear motor, in a reciprocating compressor for a refrigerator which controls a cooling capacity by varying a stroke of a piston reciprocating up and down by a voltage applied to the inner motor according to an on/off state of a triac, the apparatus comprises a first capacitor for attenuating an inductance of a coil wound on the motor; a second capacitor connected to the first capacitor in parallel; and a relay connected to the second capacitor in series to be turned on/off, wherein the method comprises the steps of detecting an off time of the triac; determining whether the driving load of the refrigerator is great or small by the detected off time of the triac; and outputting the control signal for turning on the relay in case of when the driving load of the refrigerator is small as a result of the determination, and outputting the control signal for turning off the relay in case of when the driving load of the refrigerator is great.

To achieve these and other advantages and in accordance with the purpose of the present invention, as embodied and broadly described herein, there is provided a method for controlling a driving of a reciprocating compressor for a refrigerator using a linear motor, in a reciprocating compressor for a refrigerator which controls a cooling capacity by varying a stroke of a piston reciprocating up and down by a voltage applied to the inner motor according to an on/off state of a triac, the apparatus comprises a first capacitor for attenuating an inductance of a coil wound on the motor; a second capacitor connected to the first capacitor in parallel; and a relay connected to the second capacitor in series to be turned on/off:, wherein the method comprises the steps of detecting an off time of the triac; determining whether the driving load of the refrigerator is great or small by the detected off time of the triac; and outputting the control signal for turning on the relay in case of when the driving load of the refrigerator is small as a result of the determination, and outputting the control signal for turning off the relay in case of when the driving load of the refrigerator is great, wherein a series combination between the first and second capacitors is set to attenuate an inductance of a coil wound to the motor.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An apparatus for controlling a driving of a reciprocating compressor for a refrigerator according to the present invention will be explained.

Figure 1:
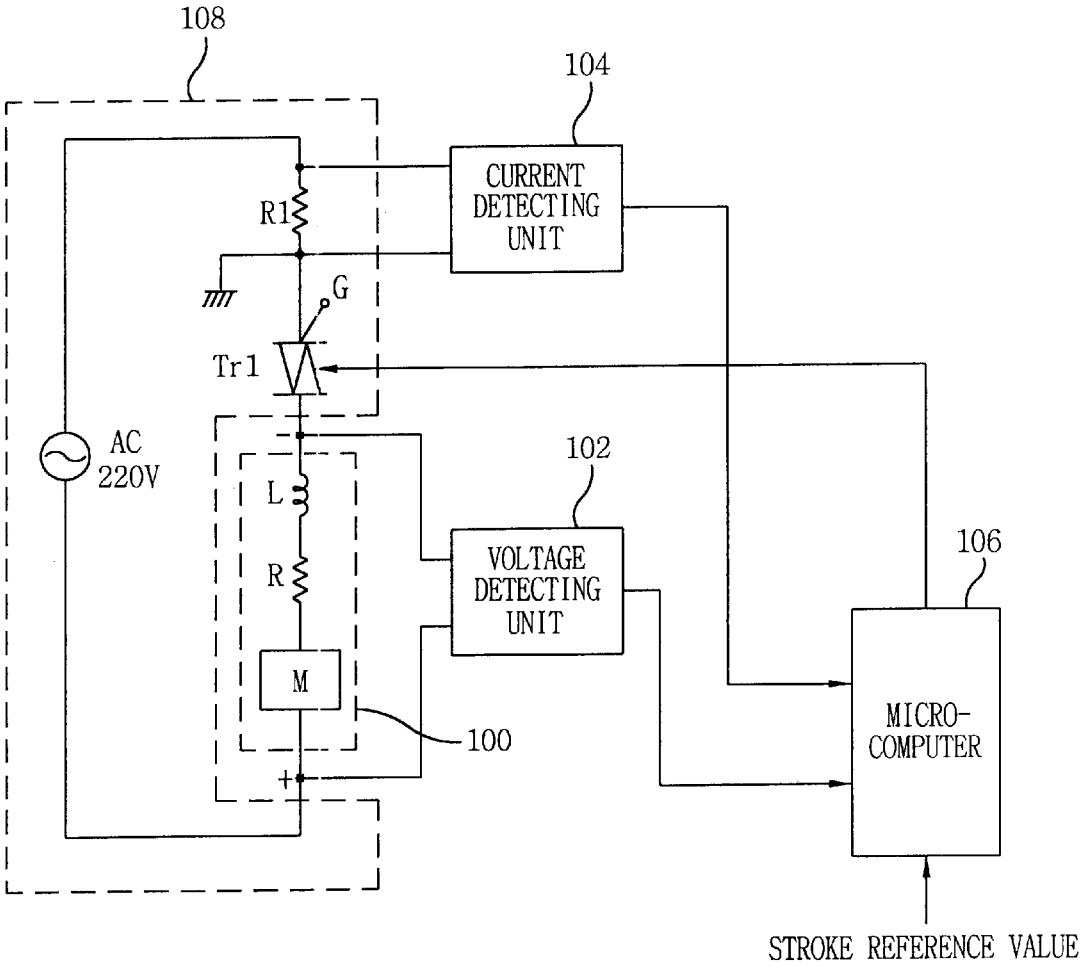
FIG. 1 CONVENTIONAL ART
FIG. 1 shows a construction of an apparatus for controlling a driving of a general reciprocating compressor.
Figure 2:
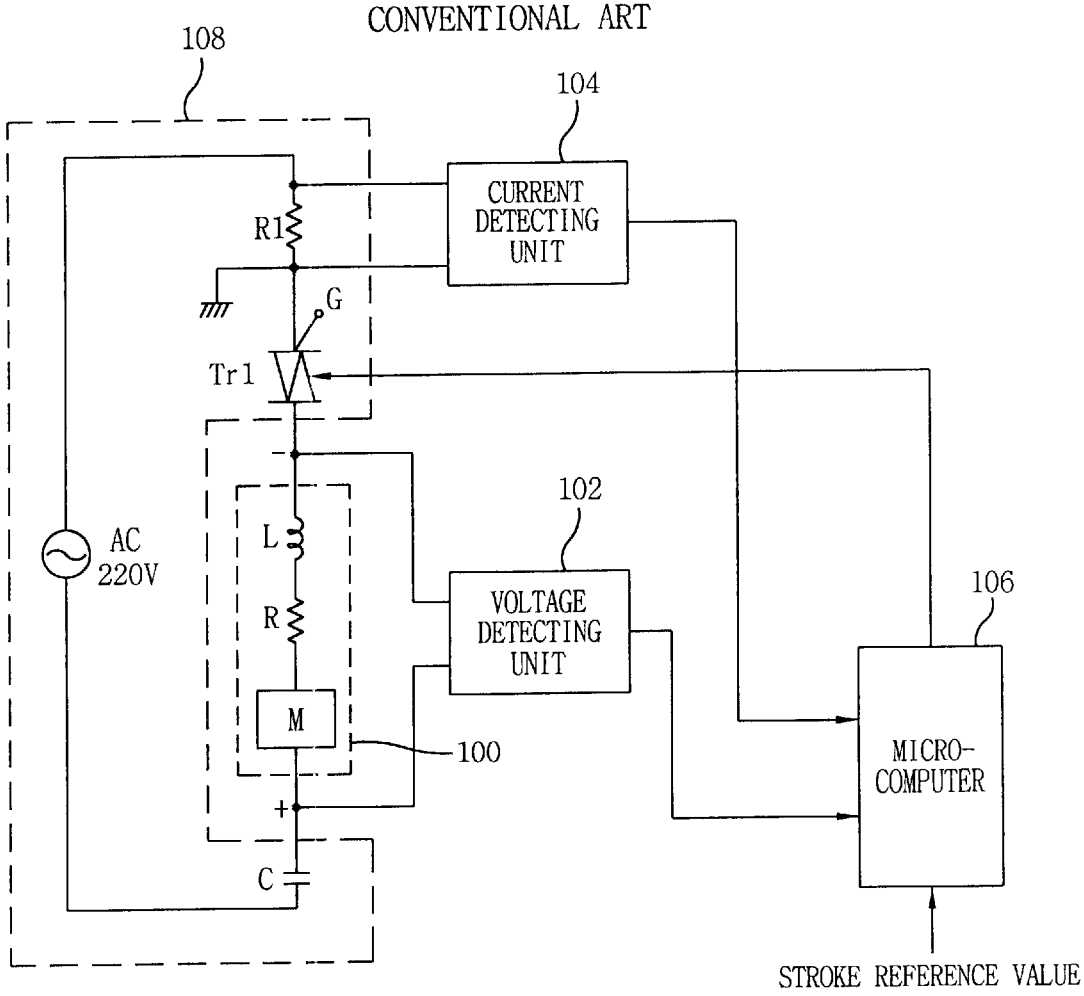
FIG. 2 CONVENTIONAL ART
FIG. 2 is a construction block diagram of an apparatus for controlling a driving of the conventional art reciprocating compressor.
Figure 3A:
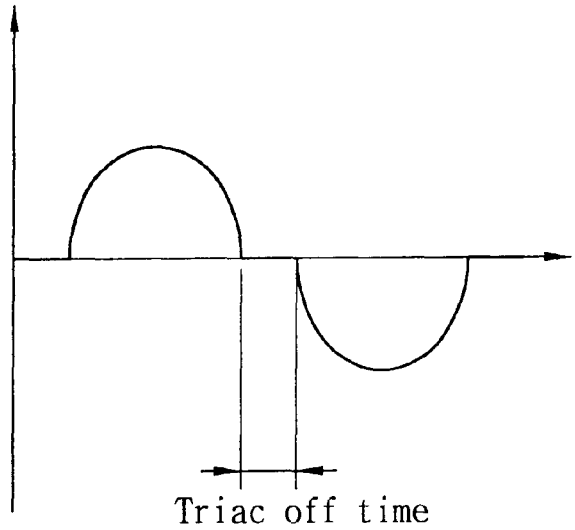
FIG. 3A CONVENTIONAL ART
FIGS. 3A and 3B show a current waveform applied to a motor of FIG. 2.
Figure 3B:
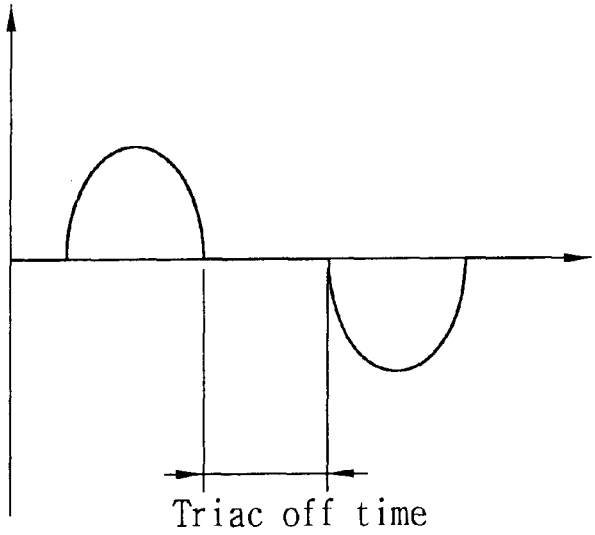
FIG. 3B CONVENTIONAL ART
Figure 4:
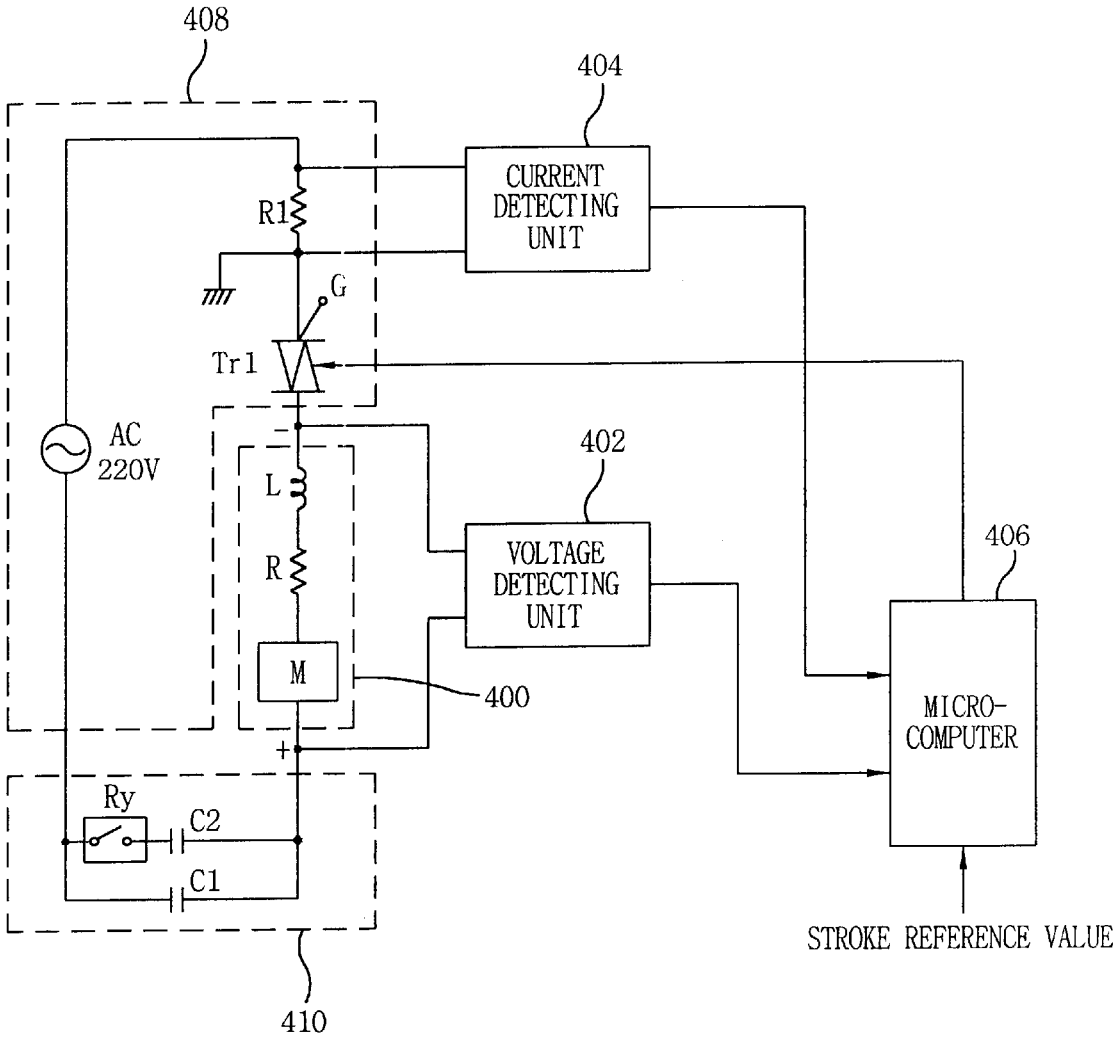
FIG. 4 is a construction block diagram showing an apparatus for controlling a driving of a reciprocating compressor for a refrigerator according to one embodiment of the present invention.

FIG. 4 is a construction block diagram showing an apparatus for controlling a driving of a reciprocating compressor for a refrigerator according to one embodiment of the present invention;

As shown in FIG. 4, the apparatus for controlling a driving of a reciprocating compressor for a refrigerator according to one embodiment of the present invention comprises a reciprocating compressor 400 for controlling a cooling capacity by varying stroke of a piston by a voltage applied to a motor according to a stroke reference value set by a user; a voltage detecting unit 402 for detecting a motor voltage applied to the reciprocating compressor 400 by increasing the stroke of the piston; a current detecting unit 404 for detecting current applied to the reciprocating compressor 400 by increasing the stroke of the piston; a microcomputer 406 for calculating a stroke using the detected voltage and current by the voltage detecting unit 402 and the current detecting unit 404, comparing the calculated stroke with a stroke reference value, outputting a switching control signal according to the comparison between the calculated stroke value and the stroke reference value, and outputting a relay control signal by determining whether a driving load is great or small; and an electric circuit unit 408 for applying voltage to the reciprocating compressor 400 by turning on/off triac according to the switching control signal of the microcomputer 406; and a voltage control unit 410 for controlling voltage applied to the reciprocating compressor 400 by varying a capacitance according to the relay control signal of the microcomputer 406.

The voltage control unit 410 includes a first capacitor C1 connected to a motor M to attenuate an inductance of a coil wound on the motor; a second capacitor C2 connected to the first capacitor C1 in parallel; and a relay Ry connected to the second capacitor C2 in series being turned on/off by the relay control signal of the microcomputer 406.

Operations for controlling a driving of the reciprocating compressor for a refrigerator according to one embodiment of the present invention will be explained.

First, the reciprocating compressor 400 controls a cooling capacity by a varied stroke of the piston, wherein the piston (not shown) reciprocates up and down by voltage applied to the motor according to the stroke reference value set by a user.

The stroke means a distance that a piston in the reciprocating compressor 400 moves with reciprocation.

A period of turn-on of a triac Tr1 of the electric circuit unit 408 becomes long by the control signal of the microcomputer 406. According to this, the stroke is increased. At this time, the voltage-detecting unit 402 and the current detecting unit 404 respectively detect the voltage and the current applied to the reciprocating compressor 400, and output the detected voltage and current to the microcomputer 406.

The microcomputer 406 calculates stroke using the voltage and the current detected by the voltage detecting unit 402 and the current detecting unit 404, compares the calculated stroke with the stroke reference value set by a user, and outputs a switching control signal to the triac Tr1 according to the comparison between the calculated stroke and the stroke reference value.

That is, when the calculated stroke is smaller than the stroke reference value, the microcomputer 106 outputs the switching control signal which lengthens the period of turn-on of the triac Tr1, thereby increasing a voltage applied to the motor M of the reciprocating compressor 400.

In the meantime, when the calculated stroke is greater than the stroke reference value, the microcomputer 406 outputs the switching control signal which shortens the period of turn-on of the triac Tr1, thereby decreasing a voltage applied to the motor M of the reciprocating compressor 400.

Also, the microcomputer 406 detects an off time of the triac Tr1, and determines whether the driving load of the refrigerator is great or small by the detected off time of the triac Tr1.

That is, the microcomputer 406 determines that the driving load of the refrigerator is small if the off time of the triac Tr1 is longer than a predetermined value, and determines that the driving load of the refrigerator is great if the off time of the triac Tr1 is shorter than the predetermined value.

The motor M of the reciprocating compress 400 requires a voltage greater than a line voltage (in Korea, AC 220) for generating stroke when the driving load of a refrigerator is greater, and requires a voltage smaller than the line voltage for obtaining a constant amount of the stroke when the driving load of a refrigerator is smaller.

Subsequently, the microcomputer 406 determines whether the driving load of the refrigerator is great or small according to the off time of the triac Tr1, and outputs the relay control signal to the voltage control unit 410 for turning on/off the relay Ry of the voltage control unit 410.

That is, the microcomputer 406 outputs the relay control signal for turning off the relay when the driving load of the refrigerator is great, and outputs the relay control signal for turning on the relay when the driving load of the refrigerator is small.

The voltage control unit 410 turns on/off the relay according to the relay control signal inputted from the microcomputer to control an equivalent capacitor by the first and second capacitors C1 and C2, thereby controlling the voltage applied to the motor M for obtaining the constant amount of the stroke.

Details will be explained as follows.

When the driving load of the refrigerator is great, the relay of the voltage control unit 410 is turned off by the relay control signal inputted from the microcomputer 406. According to this, only the first capacitor C1 is connected to the motor M, and a voltage of the first capacitor C1 is applied to the motor M.

At this time, the capacitor voltage of the first capacitor C1 applied to the motor M and an inductance voltage of the coil are attenuated, so that a necessary voltage of the motor for obtaining the constant amount of the stroke becomes small as a similar value with the line voltage (in Korea, AC 220V). The capacitance of the first capacitor C1 and the inductance of the coil are predetermined as resonant values.

In the meantime, when the driving load of the refrigerator is small, the relay of the voltage control unit 410 is turned on by the relay control signal inputted from the microcomputer 406, so that the first and second capacitors C1 and C2 are connected to the motor M.

Accordingly, a capacitor voltage according to the equivalent capacitance corresponding to a sum between first capacitance of the first capacitor C1 and second capacitance of the second capacitor C2 is applied to the motor.

At this time, a resonance between the equivalent capacitance and inductance of the motor M is destroyed, so that the necessary voltage of the motor for obtaining a constant amount of the stroke increases a similar value with the line voltage (AC 220V).

That is, when the driving load of the refrigerator is great, the necessary voltage of the motor M for generating stroke becomes greater than the line voltage, so that the microcomputer 406 turns off the relay, so that the voltage of the first capacitor C1 and the inductance voltage of the motor are attenuated each other according to LC resonance. Therefore, the motor M can obtain the constant amount of the stroke by the line voltage lower than the necessary voltage.

In the meantime, when the driving load of the refrigerator is small, the necessary voltage of the motor M for generating stroke becomes greater than the line voltage, so that the microcomputer 406 turns off the relay, so that the voltage of the first capacitor C1 and the inductance voltage of the motor are attenuated each other according to LC resonance. Therefore, the motor can obtain the constant amount of the stroke by the line voltage lower than the necessary voltage.

Figure 5:
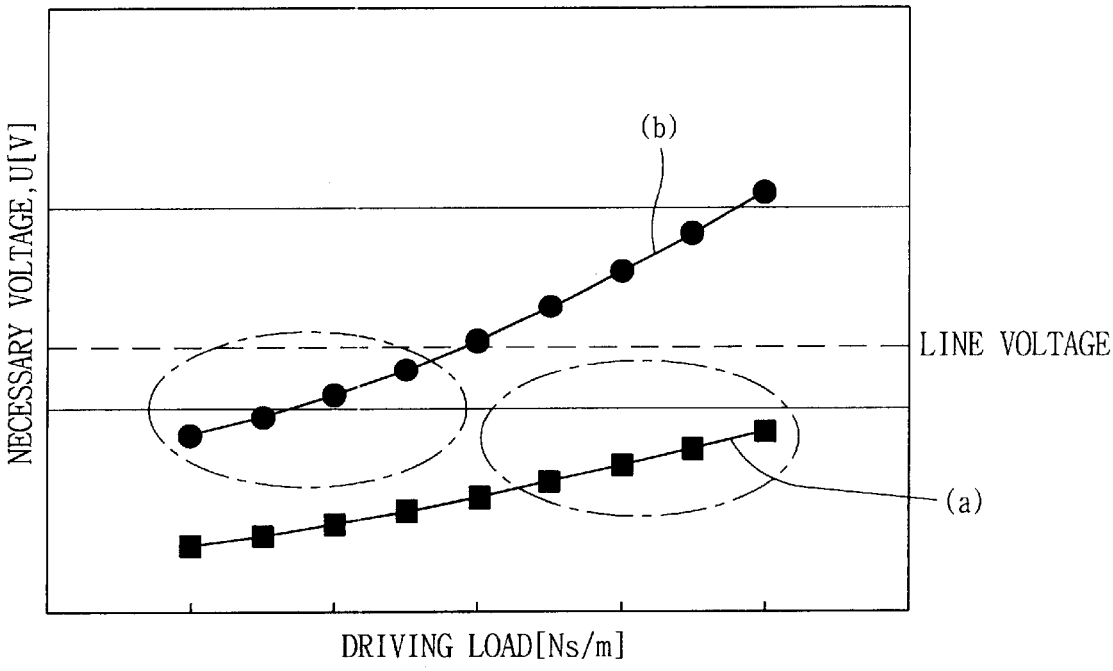
FIG. 5 is a graph showing necessary voltage of a motor according to a driving load.

FIG. 5 is a graph showing necessary voltage of a motor according to a driving load.

As shown in FIG. 5, when the driving load is small, the necessary voltage of the motor M is smaller than the line voltage, and when the driving load is great, the necessary voltage of the motor M is greater than the line voltage.

Accordingly, as shown in graph (a), when the driving load is great, a capacitor having a capacitor voltage being resonant with the inductance voltage of the coil wound on the motor M is used, thereby obtaining the necessary voltage of the motor M corresponding to an approximate value with the line voltage.

Also, as shown in graph (b), when the driving load is small, a capacitor having a capacitor voltage greater than the inductance voltage of the coil wound on the motor M is used, thereby obtaining the necessary voltage of the motor M corresponding to an approximate value with the line voltage.

Figure 6A:
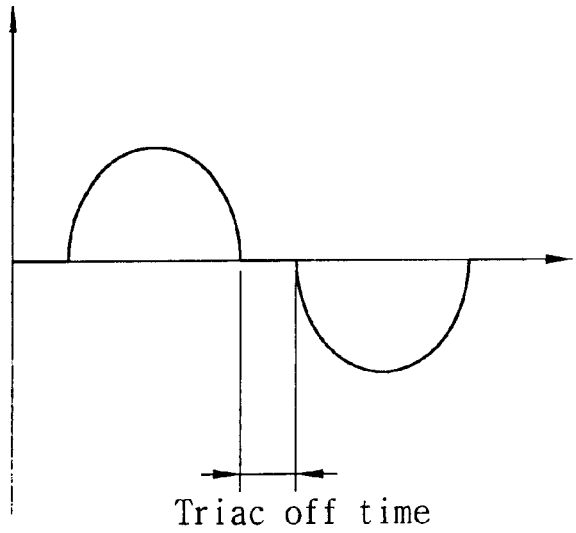
FIGS. 6A and 6B show a current waveform applied to a motor according to one embodiment of the present invention.
Figure 6B:
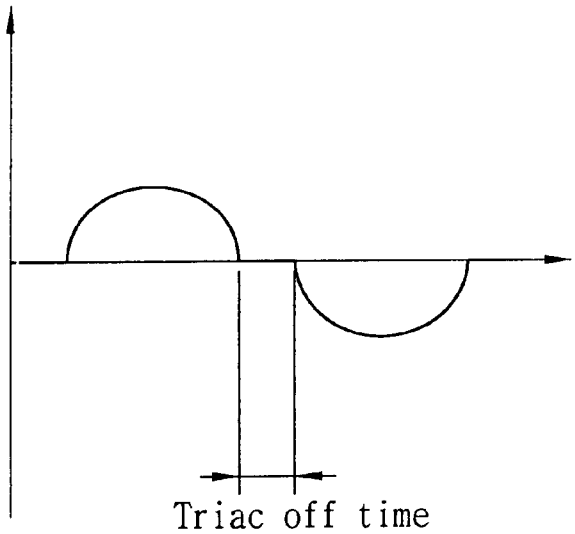

FIGS. 6A and 6B show a current waveform according to a driving load.

FIG. 6A is a current waveform when a driving load is great, and FIG. 6*b* is a current waveform when a driving load is small.

As shown in FIG. 6B, when the driving load is small, the relay is turned on, thereby increasing the necessary voltage of the motor M for obtaining the constant amount of the stroke by the first and second capacitors C1 and C2. According to this, the off time of the triac Tr1 is decreased, and an amplitude of the current is also decreased.

Operations for controlling a driving of a reciprocating compressor for a refrigerator according to one embodiment of the present invention will be expressed as follows.

$$MV' + C_f V + K\int V dt = \alpha I \qquad \text{[Equation 5]}$$

$$RI + LI' + \frac{1}{C}\int I dt + \alpha V = U$$

Wherein, M indicates a mass of movable body [kg], $C_f$ is a load damping coefficient [Ns/m], K is a spring constant of motion field [N/m], α is a correlation coefficient of power-current [N/A], V is a speed of the movable body [m/s], V' is a differential value of V, I is a driving current flowing in the motor[A], I' is a differential value of I, R is a motor resistance [Ω], L is a reactance [H], C is a capacitance [F], and U is an applied voltage [V].

The equation 5 was derived by eliminating triac in the reciprocating compressor and by linearizing.

If the equation 5 is represented as a vector, it is expressed like a following equation 6.

$$Z_m = R_m + jX_m = C_f + j\left(M\omega - \frac{K}{\omega}\right) \qquad \text{[Equation 6]}$$

$$Z_e = R_e + jX_e = R + j\left(L\omega - \frac{1}{C\omega}\right)$$

If the equation 6 is substituted as a current vector, it is expressed as an equation like a following equation 7.

$$Z_t I = U \qquad \text{[Equation 7]}$$

$$Z_t = \left(Z_e + \frac{\alpha^2}{Z_m}\right)$$

A total impedance ($Z_t$) of the reciprocating compressor is equal to the equation 7. When a constituent of imaginary number of the impedance becomes "0", the necessary voltage of the motor for obtaining the constant amount of the stroke is the least.

Also, as shown in the Equation 7, as the driving load ($Z_m$) of the reciprocating compressor becomes different, an impedance value is changed and the necessary voltage for obtaining the constant amount of the stroke becomes different.

A method for controlling a driving of the reciprocating compressor for a refrigerator according to one embodiment of the present invention will be explained with reference to the attached drawings.

Figure 7:
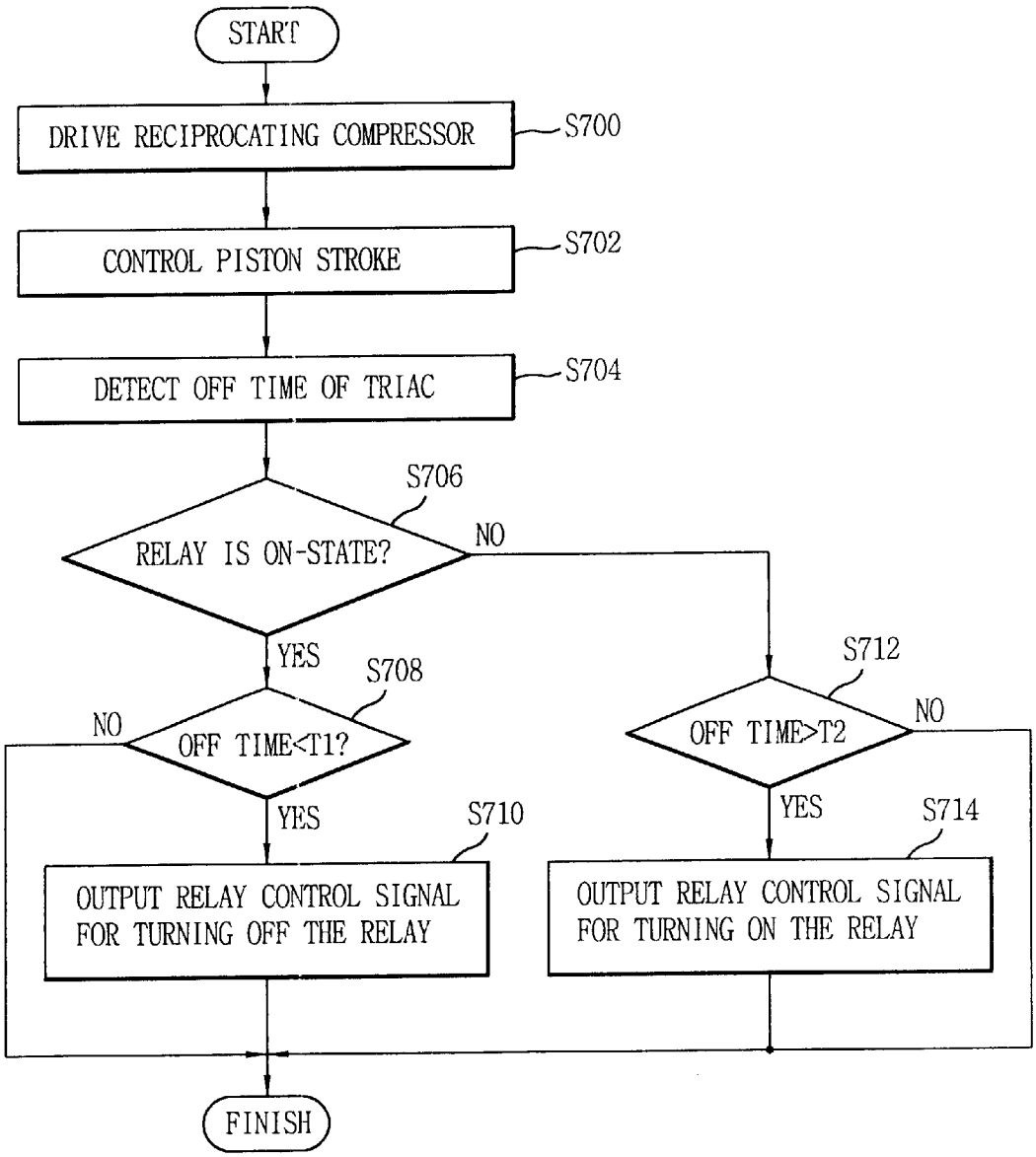
FIG. 7 is a flow chart to perform a controlling of a driving of a reciprocating compressor for a refrigerator according to one embodiment of the present invention.

FIG. 7 is a flow chart for controlling a driving of the reciprocating compressor for a refrigerator according to one embodiment of the present invention.

First, the microcomputer 406 drives the reciprocating compressor 400 (S700), and controls a piston stroke by controlling the off time of the triac Tr1 (S702).

Subsequently, the microcomputer 406 detects the off time of the triac Tr1 (S704), and detects an on/off state of the relay (S706).

When the relay is in the on state (S706), the microcomputer 406 compares the off time of the triac Tr1 detected in the above step (S704) and a predetermined high load determination time T1 (S708).

In the above step (S708), when the off time of the triac Tr1 is shorter than the predetermined high load determination time T1, the microcomputer 406 determines that the driving load of the refrigerator is great, thereby outputting a relay control signal for turning off the relay to the voltage control unit 410 (S710).

At this time, in the above step (S708), the off time of the triac Tr1 is longer than the predetermined high load determination time T1, the microcomputer 406 maintains the on-state of the relay Ry.

In the meantime, when the relay is in the off state, the microcomputer 406 compares the detected off time of the triac Tr1 with a predetermined low load determination time T2 (S712).

Wherein, the predetermined low load determination time T2 is longer than the predetermined high load determination time T1.

When the detected off time of the triac Tr1 in the above step (S712) is longer than the predetermined low load determination time T2, the microcomputer 406 determines that the driving load of the refrigerator is small, thereby outputting a relay control signal for turning on the relay to the voltage control unit 410 (S714).

At this time, when the detected off time of the triac Tr1 in the above step (S712) is shorter than the predetermined low load determination time T2, the microcomputer 406 maintains the off-state of the relay Ry.

When the detected off time of the triac Tr1 is ranged from the low load determination time T2 and the high load determination time T1, the microcomputer 406 maintains a present state of the relay Ry.

That is, when the off time of the triac Tr1 is minutely changed by the low load determination time T2 and the high load determination time T1 having constant time intervals, the microcomputer 406 prevents the relay Ry from unnecessarily being on/off.

Wherein, since operations to increase or decrease necessary voltage of the motor M for obtaining the constant amount of the stroke according to on/off of the relay Ry are already explained, another explanation will be omitted.

An apparatus for controlling a driving of a reciprocating compressor for a refrigerator according to another embodiment of the present invention will be explained with reference to attached drawings.

Figure 8:
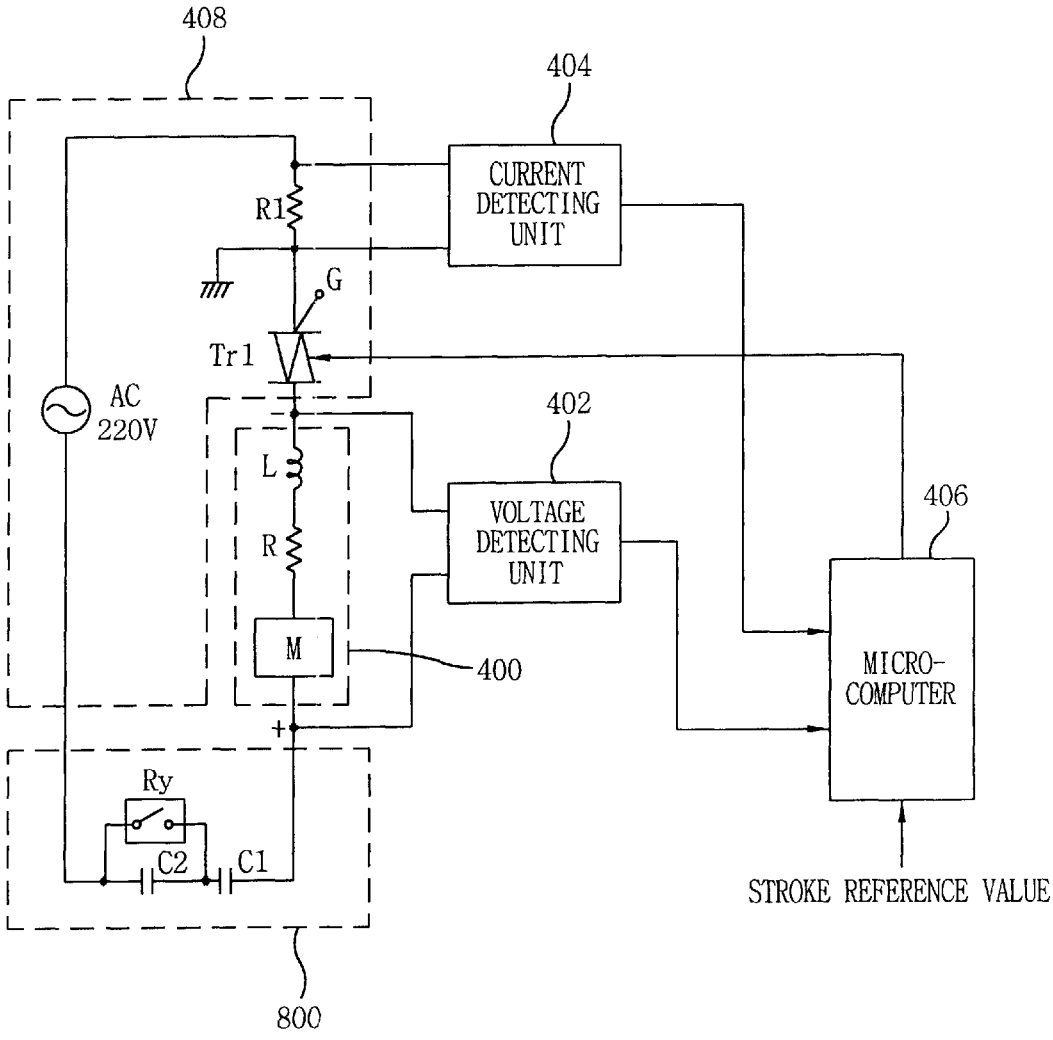
FIG. 8 is a construction block diagram showing an apparatus for controlling a driving of a reciprocating compressor for a refrigerator according to another embodiment of the present invention.

FIG. 8 is a construction block diagram of an apparatus for controlling a driving of a reciprocating compressor for a refrigerator according to another embodiment of the present invention.

Construction parts equal to the one embodiment of the present invention will have the same reference numerals.

Referring to FIG. 8, an apparatus for controlling a driving of a reciprocating compressor for a refrigerator according to another embodiment of the present invention comprises a reciprocating compressor 400, a voltage detection unit 402, a current detection unit 404, a microcomputer 406, an electric circuit unit 408, and a voltage control unit 800.

The voltage control unit 800 includes a first capacitor C1, a second capacitor C2 connected to the first capacitor C1 in series, and a relay connected to the second capacitor C2 in parallel.

At this time, a series combination between the first and second capacitors C1 and C2 attenuates an inductance of a coil wound on a motor of the reciprocating compressor 400.

Since another embodiment of the present invention has the same construction parts with that of the one embodiment except the voltage control unit 800, detailed explanations will be omitted.

Operations for controlling a driving of a reciprocating compressor according to another embodiment of the present invention will be explained.

The microcomputer 406 detects an off time of a triac Tr1, and determines that a driving load of the refrigerator is great or small by the detected off time of the triac Tr1, thereby outputting a relay control signal for turning on/off the relay Ry to the voltage control unit 800.

That is, the microcomputer 406 outputs the relay control signal for turning off the relay Ry when the driving load of the refrigerator is great, and outputs the relay control signal for turning on the relay Ry when the driving load of the refrigerator is small.

The voltage control unit 800 turns on/off the relay according to the relay Ry control signal inputted from the microcomputer 406, so that an equivalent capacitance by the first and second capacitors C1 and C2 is controlled, so that the voltage control unit 800 controls a necessary voltage of the motor for obtaining a constant amount of the stroke.

Details will be explained.

When the driving load of the refrigerator is great, the relay Ry of the voltage control unit 800 is turned off by the relay control signal. According to this, the first and second capacitors C1 and C2 are connected to the motor M in series, so that a capacitor voltage by the equivalent capacitance $$\left(C = \frac{C1 \times C2}{C1 + C2}\right)$$

obtained from the first and second capacitors C1 and C2 is applied to the motor M.

At this time, the capacitor voltage by the equivalent capacitance C applied to the motor M and an inductance voltage of the coil are attenuated, so that the necessary voltage of the motor for obtaining the constant amount of the stroke becomes small as a similar value with a line voltage (in Korea, AC 220V). The equivalent capacitance C and the inductance of the coil are predetermined as resonant values.

In the meantime, when the driving load of the refrigerator is small, the relay Ry of the voltage control unit 800 is turned on by the relay control signal inputted from the microcomputer 406, so that the first capacitor C1 is connected to the motor.

Accordingly, a voltage of the first capacitor C1 is applied to the motor. At this time, resonance between capacitance of the first capacitor C1 and inductance of the motor is destroyed, so that the necessary voltage of the motor for obtaining the constant amount of the stroke increases a similar value with the line voltage (in Korea AC 220V).

That is, when the driving load of the refrigerator is great, the necessary voltage of the motor for generating stroke is greater than the line voltage.

According to this, the microcomputer 406 attenuates the capacitance voltage by the equivalent capacitance $$\left(C = \frac{C1 \times C2}{C1 + C2}\right)$$

from the first and second capacitors C1 and C2 and inductance voltage of the motor according to the LC resonance, so that the motor can obtain stroke by the line voltage lower than the necessary voltage.

In the meantime, when the driving load of the refrigerator is small, the necessary voltage of the motor for obtaining the constant amount of the stroke is smaller than the line voltage, so that the relay Ry is turned on, thereby destroying LC resonance between the motor and the inductance voltage by capacitor voltage of the first capacitor C1. Therefore, the motor M can obtain the constant amount of the stroke by the line voltage higher than the necessary voltage.

A method for controlling the driving of a reciprocating compressor for a refrigerator according to another embodiment of the present invention is the same with the one embodiment of the present invention shown in FIG. 7, so that detailed explanations will be omitted.

As aforementioned, in the present invention, the equivalent capacitance is varied by whether the driving load of the refrigerator is great or small, thereby controlling the necessary voltage of the motor for obtaining the constant amount of the stroke.

Therefore, in the present invention, when the driving load for the refrigerator is small, the necessary voltage for obtaining the constant amount of the stroke is increased, and when the driving load of the refrigerator is great, the necessary voltage for obtaining the constant amount of the stroke is decreased, thereby reducing the off time of the triac Tr1.

Therefore, in the present invention, a characteristic for corresponding to current by varied driving loads is increased, thereby improving a driving efficiency of a reciprocating compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling a driving of a reciprocating compressor for a refrigerator using a linear motor, in a reciprocating compressor for a refrigerator which controls a cooling capacity by varying stroke of a piston reciprocating up and down by a voltage applied to a linear motor according to on/off of a triac, the apparatus comprising:

a first capacitor configured to attenuate inductance of a coil wound on a motor;

a second capacitor connected to the first capacitor in parallel;

a relay connected to the second capacitor in series to be turned on/off; and a microcomputer configured to output a control signal to turn on/off the relay according to a driving load of the refrigerator.

2. The apparatus of claim 1, wherein the microcomputer determines whether a driving load of the refrigerator is great or small according to an off time of the triac.

3. The apparatus of claim 2, wherein the microcomputer determines the following:

if an off time of the triac is longer than a predetermined low load determination time, the driving load of the refrigerator is small, and if the off time of the triac is shorter than a predetermined high load determination time, the driving load of the refrigerator is great, wherein the predetermined low load determination time is longer than the predetermined high load determination time.

4. The apparatus of claim 1, wherein the microcomputer is further configured to output a control signal for turning on the relay if the driving load of the refrigerator is small, and output a control signal for turning off the relay if the driving load of the refrigerator is great.

5. An apparatus for controlling a driving of a reciprocating compressor for a refrigerator using a linear motor, in a reciprocating compressor for a refrigerator which controls a cooling capacity by varying stroke of a piston reciprocating up and down by a voltage applied to the linear motor according to on/off of triac, the apparatus comprising:

a first capacitor connected to the motor;

a second capacitor connected to the first capacitor in parallel;

a relay connected to the second capacitor in series to be turned on/off; and a microcomputer configured to output a control signal to turn on/off the relay according to a driving load of the refrigerator, wherein a series combination between the first and second capacitors is set to attenuate inductance of a coil wound to the motor.

6. The apparatus of claim 5, wherein the microcomputer determines whether the driving load of the refrigerator is great or small according to an off time of the triac.

7. The apparatus of claim 6, wherein the microcomputer determines the following:

if the off time of the triac is longer than a predetermined low load determination time, the driving load of the refrigerator is small, and if the off time of the triac is shorter than a predetermined high load determination time, the driving load of the refrigerator is great, wherein the predetermined low load determination time is longer than the predetermined high load determination time.

8. The apparatus of claim 5, wherein the microcomputer is further configured to output a control signal for turning on the relay if the driving load of the refrigerator is small, and output a control signal for turning off the rely relay if the driving load of the refrigerator is great.

9. An apparatus for controlling a driving of a reciprocating compressor for a refrigerator using a linear motor, in a reciprocating compressor for a refrigerator which controls a cooling capacity by varying a stroke of a piston according to a voltage applied to the linear motor, the apparatus comprising:

a microcomputer configured to output a control signal according to a driving load of the refrigerator; and a voltage control unit configured to control the voltage applied to the motor by varying capacitance according to the control signal of the microcomputer.

10. The apparatus of claim 9, wherein the voltage control unit includes:

a first capacitor configured to attenuate inductance of a coil wound on the motor;

a second capacitor connected to the first capacitor in parallel; and a relay connected to the second capacitor in series to be turned on/off.

11. The apparatus of claim 10, wherein when the driving load of the refrigerator is small, the relay is turned on by the control signal of the microcomputer.

12. The apparatus of claim 9, wherein the voltage control unit includes:

a first capacitor connected to the motor;

a second capacitor connected to the first capacitor in series; and a relay connected to the second capacitor in parallel to be turned on/off, wherein a series combination between the first and second capacitors is set to attenuate inductance of a coil wound on the motor.

13. The apparatus of claim 12, wherein when the driving load of the refrigerator is small, the relay is turned on by a control signal of the microcomputer.

14. A method for controlling a driving of a reciprocating compressor for a refrigerator using a linear motor and control apparatus, in a reciprocating compressor for a refrigerator which controls a cooling capacity by varying a stroke of a piston reciprocating up and down by a voltage applied to the linear motor according to on/off of a triac, the control apparatus comprising a first capacitor for attenuating inductance of a coil wound on the linear motor, a second capacitor connected to the first capacitor in parallel, and a relay connected to the second capacitor in series to be turned on/off, wherein the method comprises:

detecting an off time of the triac;

determining whether a driving load of the refrigerator is great or small by the detected off time of the triac; and outputting a control signal for turning on the relay, when the driving load of the refrigerator is small, as a result of the determination, and outputting a control signal for turning off the relay, when a driving load of the refrigerator is great.

15. A method for controlling a driving of a reciprocating compressor for a refrigerator using a linear motor and control apparatus, in a reciprocating compressor for a refrigerator which controls a cooling capacity by varying a stroke of a piston reciprocating up and down by a voltage applied to the linear motor according to on/off of a triac the control apparatus comprising a first capacitor connected to the linear motor, a second capacitor connected to the first capacitor in series, and a relay connected to the second capacitor in parallel to be turned on/off, wherein a series combination between the first and second capacitors is set to attenuate inductance of a coil wound on the linear motor, the method comprising:

detecting an off time of the triac;

determining whether a driving load of the refrigerator is great or small by the detected off time of the triac; and outputting a control signal for turning on the relay, when the driving load of the refrigerator is small, as a result of the determination, and outputting the control signal for turning off the relay, when a driving load of the refrigerator is great.

* * * * *